US009352196B2

(12) United States Patent
Onuki et al.

(10) Patent No.: US 9,352,196 B2
(45) Date of Patent: May 31, 2016

(54) GOLF CLUB

(71) Applicant: DUNLOP SPORTS CO. LTD., Kobe-shi, Hyogo (JP)

(72) Inventors: Masahide Onuki, Kobe (JP); Masaru Kono, Kobe (JP); Tomio Kumamoto, Kobe (JP)

(73) Assignee: DUNLOP SPORTS CO., LTD., Kobe-shi (JP)

( * ) Notice: Subject to any disclaimer, the term of this patent is extended or adjusted under 35 U.S.C. 154(b) by 295 days.

(21) Appl. No.: 13/870,048

(22) Filed: Apr. 25, 2013

(65) Prior Publication Data

US 2013/0288818 A1 Oct. 31, 2013

(30) Foreign Application Priority Data

Apr. 26, 2012 (JP) ..... 2012-101739

(51) Int. Cl.

| | |
|---|---|
| ***A63B 53/04*** | (2015.01) |
| ***B41M 5/26*** | (2006.01) |
| ***B41M 5/30*** | (2006.01) |
| *A63B 71/06* | (2006.01) |
| *B41M 5/28* | (2006.01) |
| *B41M 5/327* | (2006.01) |
| *B41M 5/333* | (2006.01) |

(52) U.S. Cl.

CPC ..... *A63B 53/04* (2013.01); *A63B 53/0466* (2013.01); *B41M 5/267* (2013.01); *B41M 5/30* (2013.01); *A63B 53/047* (2013.01); *A63B 53/0487* (2013.01); *A63B 2053/0437* (2013.01); *A63B 2071/0694* (2013.01); *A63B 2209/00* (2013.01); *B41M 5/262* (2013.01); *B41M 5/283* (2013.01); *B41M 5/327* (2013.01); *B41M 5/3275* (2013.01); *B41M 5/3335* (2013.01); *B41M 5/3336* (2013.01); *B41M 5/3338* (2013.01)

(58) Field of Classification Search

USPC ..... 473/324–350

See application file for complete search history.

(56) References Cited

U.S. PATENT DOCUMENTS

| | | | |
|---|---|---|---|
| 2003/0017886 | A1 | 1/2003 | Takeda |
| 2006/0050095 | A1 | 3/2006 | Kakuno et al. |

FOREIGN PATENT DOCUMENTS

| | | | | |
|---|---|---|---|---|
| JP | 5-58024 | A | | 3/1993 |
| JP | 8-25809 | A | | 1/1996 |
| JP | 2000-218999 | A | | 8/2000 |
| JP | 2003-33454 | A | | 2/2003 |
| JP | 2005-13529 | A | | 1/2005 |
| JP | 2005-28013 | A | | 2/2005 |
| JP | 2006-75253 | A | | 3/2006 |
| JP | 2006-271771 | A | | 10/2006 |
| JP | 2009000136 | A | * | 1/2009 |
| JP | 3148964 | U | | 3/2009 |

* cited by examiner

*Primary Examiner* — John E Simms, Jr.

(74) *Attorney, Agent, or Firm* — Birch, Stewart, Kolasch & Birch, LLP

(57) ABSTRACT

A golf club c1 has a base part 2, a laser discoloration layer 6, and a protection layer 8. The laser discoloration layer 6 is provided on the outer side of the base part 2. The protection layer 8 is provided on the outer side of the laser discoloration layer 6. The protection layer 8 has laser beam transparency. The laser discoloration layer 6 can be discolored by irradiation of a laser beam. Preferably, an undercoat layer 4 is further provided between the base part 2 and the laser discoloration layer 6. Preferably, the undercoat layer 4 is not discolored by the laser beam. Preferably, the laser discoloration layer 6 includes abase material resin and a laser discoloration material.

10 Claims, 3 Drawing Sheets

GOLF CLUB

The present application claims priority on Patent Application No. 2012-101739 filed in JAPAN on Apr. 26, 2012, the entire contents of which are hereby incorporated by reference.

BACKGROUND OF THE INVENTION

1. Field of the Invention

The present invention relates to a golf club.

2. Description of the Related Art

Indication such as a character or a mark is provided on a golf club. The indication has various functions. The indication can indicate the specification of the golf club or the like. The indication can be useful in discriminating the golf club from clubs of others.

Japanese Patent Application Laid-Open No. 2006-271771 discloses a head having a basis material, a silver nitride layer, a base coat layer, an ink jet printing layer, and a protection layer.

Japanese Patent Application Laid-Open No. 2000-218999 discloses a member having a decoration layer. The gazette discloses that the decoration layer has a brilliant layer and a colored layer and the colored layer has translucency. A golf club is described as one of applications.

Japanese Patent Application Laid-Open No. 2005-13529 discloses a golf club having a pattern part. The pattern part has a pattern sheet part, and an intercoating layer and a protection layer formed on the pattern sheet part. The pattern part is projected from the other portions.

Japanese Patent Application Laid-Open No. 2005-28013 discloses a surface treatment method three-dimensionally striking up a pattern. An abradant is sprayed by air blast to roughen a pattern portion. Furthermore, the pattern is three-dimensionally struck up by applying color clear.

Japanese Utility Model Application Publication No. 3148964 discloses a golf club head having a main body layer, a primary color layer, and a filling layer. The filling layer is set in a decoration notched part of the primary color layer. The gazette discloses that laser engraving is utilized for forming the decoration notched part.

Japanese Patent Application Laid-Open No. 2006-75253 (US2006/0050095) discloses a golf ball marking apparatus including an ink jet head.

SUMMARY OF THE INVENTION

A marking is preferably easy to mark. The marking which is easy to mark has various utility values. On the other hand, durability is required for the marking of the golf club.

It is an object of the present invention to provide a golf club which enables an easy marking having high durability.

A golf club according to the present invention has a base part, a laser discoloration layer, and a protection layer. The laser discoloration layer is provided on the outer side of the base part. The base part constitutes a portion of the golf club. The protection layer is provided on the outer side of the laser discoloration layer. The protection layer has laser beam transparency. The laser discoloration layer can be discolored by irradiation of a laser beam.

Preferably, an undercoat layer is further provided between the base part and the laser discoloration layer. Preferably, the undercoat layer is not discolored by the laser beam.

Preferably, the laser discoloration layer includes a base material resin and a laser discoloration material.

Preferably, the base part is a metal.

Preferably, the base part is a fiber-reinforced resin.

DESCRIPTION OF THE PREFERRED EMBODIMENTS

Hereinafter, the present invention will be described in detail based on preferred embodiments with appropriate references to the drawings.

Figure 1:
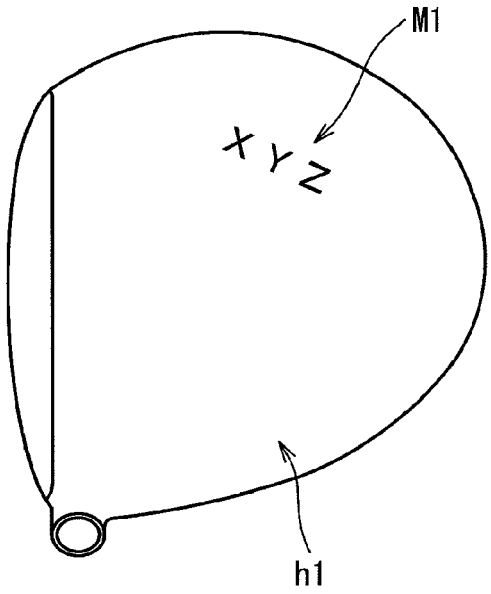
FIG. 1 is a plan view of a head used for a golf club according to one embodiment of the present invention.

In a head h1 shown in FIG. 1, a marking M1 is applied to a crown. The marking includes three characters of "X", "Y", and "Z".

The kind of the head h1 is not limited. Examples of the head h1 include a wood type head, a hybrid type head, a utility type head, an iron type head, and a putter head.

The marking is not limited. Examples of the marking include a character and a picture. More specific examples of the marking include an illustration, a mark, a club specification, a club owner's name, a date of a memorial day, a manufacture name, and a trade name.

Figure 2:
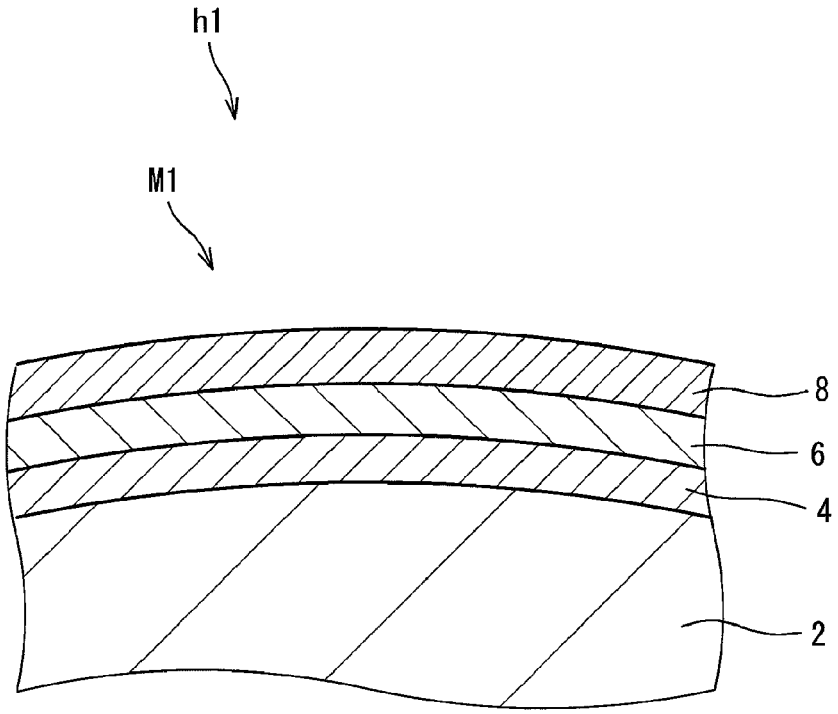
FIG. 2 is an enlarged cross-sectional view of the head in a portion on which a marking is provided.

FIG. 2 is a cross-sectional view of the head h1 in a portion on which the marking M1 is provided.

Figure 3:
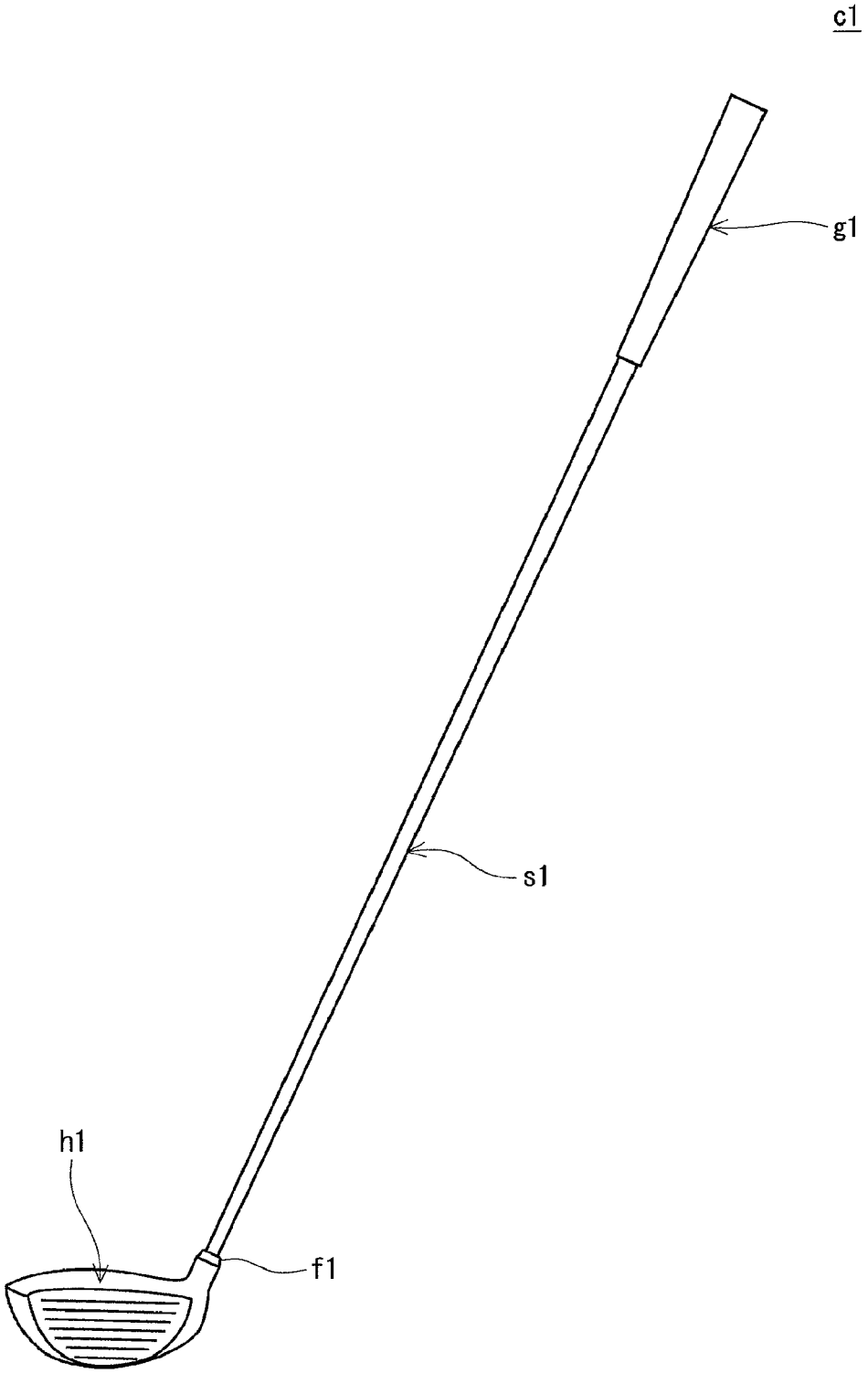
FIG. 3 is an overall view of the golf club according to one embodiment of the present invention.

FIG. 3 shows a golf club c1 according to one embodiment of the present invention. The golf club c1 has a head h1, a shaft s1, a grip g1, and a ferrule f1.

The marking M1 is provided at a position where the marking M1 can be visually observed. The marking M1 is provided on the surface of the golf club c1. The position of the marking M1 is not limited.

The marking M1 may be provided on the surface of the shaft s1. A base part 2 may be a shaft body.

The marking M1 may be provided on the surface of the grip g1. The base part 2 may be a grip body.

The marking M1 may be provided on the surface of the ferrule f1. The base part 2 may be a ferrule body.

When the marking M1 is provided on the head, a portion in which the marking M1 is set is not limited. Examples of the position of the marking M1 include a crown, a face, a sole, a side, a neck, a hosel, and a top blade. In the case of a cavity back iron, the marking M1 may be provided in a cavity.

The marking M1 may be used for indicating a specification. Examples of the specification include an iron number, a loft angle, a lie angle, a face angle, shaft flex, shaft torque, a shaft flex point, a shaft weight, club balance (swing weight), and a clubweight.

The specification may be data measured after the assembly of the club. The specification may be data measured after a member to which the marking M1 is applied is coated. The specification may be data measured after a laser discoloration layer 6 and a protection layer 8 are formed. Since data measured in a state nearer completion can be indicated in these cases, the accuracy of indication data can be improved. Labor and time of indicating the specification in a metal mold of the head or indicating the specification on the shaft by screen printing can be omitted. Therefore, the productivity of the club can be improved.

The specification indicated by the marking M1 may be a measurement value itself of each club or a club part. The specification of the golf club has fluctuation for each individual. The specification may be delicately different even in the same product class. Each measurement value itself is indicated, and thereby exact data indication is enabled regardless of the fluctuation. The club part is a head, a shaft, a grip, or a ferrule or the like.

In the embodiment, the marking M1 is provided on the head h1. The head h1 has the base part 2, an undercoat layer 4, the laser discoloration layer 6, and the protection layer 8. The base part 2 is a head body.

The material of the base part 2 is not limited. Examples of the material of the base part 2 include a metal, a resin, and FRP (fiber-reinforced resin). Examples of the metal include titanium, a titanium alloy, soft iron (low carbon steel having a carbon content of less than 0.3 wt %), stainless steel, maraging steel, an aluminium alloy, and a magnesium alloy. Examples of the FRP include CFRP, a glass fiber-reinforced resin, an alumina fiber-reinforced resin, and an aramid fiber-reinforced resin. The CFRP means a carbon fiber-reinforced resin.

The undercoat layer 4 is a coating film, for example. The undercoat layer 4 is not discolored by a laser beam. The undercoat layer 4 is not colored by the laser beam. The undercoat layer 4 is not discolored by the laser beam capable of discoloring the laser discoloration layer 6. The undercoat layer 4 can emphasize the indication by the laser discoloration layer 6. The undercoat layer 4 can contribute to improving the visibility of the marking M1. Preferably, the color of the laser discoloration layer 6 discolored by the laser beam is different from the color of the undercoat layer 4. The undercoat layer 4 may not be provided.

The undercoat layer 4 is provided between the base part 2 and the laser discoloration layer 6. The undercoat layer 4 is provided on the outer side of the base part 2. In the embodiment, the base part 2 and the undercoat layer 4 are brought into contact with each other. Other layer may be provided between the base part 2 and the undercoat layer 4.

The undercoat layer 4 is preferably a coating material. A coating material normally used can be employed as the undercoat layer 4. The base material resin of the undercoat layer 4 is not limited. Examples of the base material resin include a polyester resin, an acrylic resin, an urethane resin, a fluorine resin, and an epoxy resin. In respects of adhesion, abrasion resistance, and water resistance, the thickness of the undercoat layer 4 is preferably 15 μm or greater and 60 μm or less.

The undercoat layer 4 may be colorless, and may be colored. The undercoat layer 4 may be transparent, and may be translucent. In respect of improving the visibility of the marking M1, the undercoat layer 4 is preferably colored. When the undercoat layer 4 is not provided, the laser discoloration layer 6 is directly provided on the surface of a club body, for example. The club body is the head body, the grip body, the shaft body, or the ferrule body or the like.

In respect of improving the visibility of the marking M1 without being influenced by the color of the club body, the undercoat layer 4 is preferably provided. In respect of improving the visibility to make the marking M1 clear, it is preferable that the undercoat layer 4 does not contain a laser discoloration material.

The laser discoloration layer 6 is provided on the outer side of the base part 2. In the embodiment, an interposing layer (undercoat layer 4) is provided between the base part 2 and the laser discoloration layer 6. The interposing layer (undercoat layer 4) may not be provided. That is, the base part 2 and the laser discoloration layer 6 may be brought into contact with each other. When the base part 2 and the laser discoloration layer 6 are brought into contact with each other, the color of the laser discoloration layer 6 discolored by the laser beam is preferably different from the color of the surface (outer surface) of the base part 2.

The laser discoloration layer 6 can be discolored by the laser beam. In the present application, "discoloration" is a concept including "coloring (color-forming)". The laser discoloration layer 6 can be colored by the laser discoloration material which will be described later. The case where the laser discoloration layer 6 is changed to a colored state from a colorless transparent state also corresponds to the "discoloration".

The protection layer 8 is provided on the outer side of the laser discoloration layer 6. In the embodiment, the protection layer 8 is brought into contact with the laser discoloration layer 6. Other layer may exist between the laser discoloration layer 6 and the protection layer 8.

The protection layer 8 has transparency. Therefore, the laser discoloration layer 6 can be visually recognized from the outside. The protection layer 8 is not discolored by the laser beam. The protection layer 8 is not colored by the laser beam. The protection layer 8 is not discolored by the laser beam capable of discoloring the laser discoloration layer 6.

The protection layer 8 has laser beam transparency. The protection layer 8 can transmit the laser beam capable of discoloring the laser discoloration layer 6. The transmittance may be less than 100%.

The protection layer 8 is preferably a coating material. The base material resin of the protection layer 8 is not limited. Examples of the base material resin include a polyester resin, an acrylic resin, an urethane resin, a fluorine resin, and an epoxy resin. In respects of adhesion, abrasion resistance, and water resistance, the thickness of the protection layer 8 is preferably 15 μm or greater and 60 μm or less.

The laser discoloration layer contains a base material resin and a laser discoloration material. Furthermore, the laser discoloration layer may contain an addition agent and a pigment or the like.

[Base Material Resin of Laser Discoloration Layer (Binder Resin)]

Examples of the base material resin of the laser discoloration layer 6 include an acrylic resin, an acryl-modified urethane resin, a styrene/acrylic resin, an ethylene/acrylic resin, an urethane resin, a polyester resin, a rosin-modified maleic resin, a vinyl chloride/vinyl acetate copolymer, a polyvinyl acetal resin, a polyamide resin, a cellulose-based resin, and a photocurable resin. Examples of the cellulose-based resin include hydroxyethyl cellulose, hydroxypropyl cellulose, and nitrocellulose. These resins may be used either alone or in combination of two or more kinds thereof.

In respects of adhesion and durability, the base material resin is preferably the urethane resin. In respect of improving the color development of the laser discoloration material, the cellulose-based resin is preferable, and the nitrocellulose resin is more preferable.

[Laser Discoloration Material]

A preferred laser discoloration material reacts to a laser beam having a wavelength of 700 nm or greater and 12000 nm or less, and is colored. Examples of the laser discoloration material include an inorganic material and an organic material.

Examples of the inorganic material which is the laser discoloration material include a metal, a metal salt, a metal hydroxide, and a metal oxide.

Examples of the metal which is the laser discoloration material include iron, zinc, tin, nickel, copper, silver, and gold.

Examples of the metal salt which is the laser discoloration material include copper carbonate, nickel carbonate, manganese carbonate, cobalt carbonate, lanthanum carbonate, magnesium nitrate, manganese nitrate, iron nitrate, cadmium nitrate, zinc nitrate, cobalt nitrate, lead nitrate, nickel nitrate, copper nitrate, palladium nitrate, lanthanum nitrate, magnesium acetate, manganese acetate, cadmium acetate, zinc acetate, cobalt acetate, lead acetate, nickel acetate, copper acetate, palladium acetate, copper chloride, iron chloride, cobalt chloride, nickel chloride, silver chloride, zinc chloride, copper phosphate, iron phosphate, cobalt phosphate, copper pyrophosphate, copper sulfate, iron sulfate, cobalt sulfate, copper oxalate, iron oxalate, cobalt oxalate, copper benzoate, iron benzoate, cobalt benzoate, and copper phosphonate having an aromatic ring.

Examples of the metal hydroxide which is the laser discoloration material include copper hydroxide, aluminium hydroxide, magnesium hydroxide, zinc hydroxide, antimony hydroxide, cobalt hydroxide, nickel hydroxide, iron hydroxide, and lanthanum hydroxide.

Examples of the metal oxide which is the laser discoloration material include silicon oxide, aluminum oxide, iron oxide, magnesium oxide, cobalt oxide, lead oxide, tin oxide, indium oxide, manganese oxide, molybdenum oxide, nickel oxide, copper oxide, palladium oxide, lanthanum oxide, antimony-doped tin oxide (ATO), indium-doped tin oxide (ITO), synthetic zeolite, natural zeolite, a copper-molybdenum composite oxide, mica coated with antimony-doped tin oxide, and mica coated with antimony-doped tin oxide/titanium oxide/silica dioxide. Other examples of the metal oxide include a substance having a layer structure. Examples of the substance having the layer structure include mica, montmorillonite, and smectite.

In respect of the color development, the copper-molybdenum composite oxide, the mica coated with antimony-doped tin oxide, and the mica coated with antimony-doped tin oxide/titanium oxide/silica dioxide are preferable in the inorganic material.

Examples of the organic material which is the laser discoloration material include a laser discoloration coloring matter. Examples of the coloring matter include a fluoran-based, phenothiazine-based, spiropyran-based, triphenylmethane phthalide-based, and rhodamine lactam-based leuco coloring matters. Preferably, the laser discoloration material is an electron-donating color developing compound.

In respect of the visibility, the laser discoloration layer 6 may contain a developer. Examples of the developer include a substance used as an electron acceptor in a thermosensitive recording body. Examples thereof include a phenol-based compound.

Specific examples of the developer (electron acceptor) include bisphenol S(4,4'-sulphonyldiphenol), 2,2',6,6'-tetramethyl-4,4'-sulphonyldiphenol, 2,2',6,6'-tetrabromo-4,4'-sulphonyldiphenol, p-hydroxybenzoic acid, 4-hydroxyisophthalic acid, 3-hydroxy-2-naphthalenecarboxylic acid, 4,4'-butylidene-bis-(3-methyl-6-t-butylphenol), 1,3,5-trimethyl-2,4,6-tris(3,5-di-t-butyl-4-hydroxybenzyl)benzene, 10-(3,5-di-t-butyl-4-hydroxybenzyl)-9,10-dihydro-9-oxa-10-phosphaphenanthrene-10-oxide, activated clay, acid clay, attapulgite, and aluminum silicate.

The leuco coloring matter is the electron-donating color developing compound. Examples of the leuco coloring matter include triarylmethanephthalide-based dyes such as 3,3'-bis(p-dimethylaminophenyl)-6-dimethylaminophthalide, 3-(p-dimethylaminophenyl)-3-(1,2-dimethylindole-3-yl)phthalide, 3,3'-bis(1,2-dimethylindole-3-yl)-5-dimethylaminophthalide, and 3-p-dimethylaminophenyl-3-(1-methylpyrrole-3-yl)-6-diethylaminophthalide; diphenylmethane-based dyes such as 4,4'-bis-dimethylaminobenzhydrylbenzylether and N-halophenylleukoauramine; thiazine-based dyes such as benzoyl leuco methylene blue; spiro-based dyes such as 3-methyl-naphtho(6'-methoxybenzo)spiropyran and 3-benzyl-spiro-dinaphthopyran; lactam-based dyes such as rhodamine-B-anilinolactam and rhodamine-B-(o-chloroanilino)lactam; fluoran-based dyes such as 3-diethylamino-7-o-fluoroanilinofluoran, 3-dimethylamino-7-o-fluoroanilinofluoran, 3-diethylamino-7-o-chloroanilinofluoran, 3-dimethylamino-7-o-chloroanilinofluoran, 3-diethylamino-7-p-chloroanilinofluoran, 3-diethylamino-7-dibenzylaminofluoran, 3-(N-cyclohexyl-N-methylamino)-6-methyl-7-phenylaminofluoran, 3-(N-tolyl-N-ethylamino)-6-methyl-7-phenylaminofluoran, 3-diethylamino-6-methyl-7-phenylaminofluoran, and 3-dibutylamino-6-methyl-7-phenylaminofluoran; and fluorene-based dyes such as 3,6,6'-tris(dimethylamino)spiro(fluorene-9,3'phthalide), 3,6-bis(dimethylamino)fluorenespiro(9,3')-6'-dimethylaminophthalide, 3,6-bis(dimethylamino)fluorenespiro(9,3')-6'-pyrrolidinophthalide, and 3-dimethylamino-6-diethylaminofluorenespiro(9,3')-6'-pyrrolidinophthalide.

Other examples of the laser discoloration material include 3-(4-diethylamino-2-ethoxyphenyl)-3-(1,2-dimethylindole-3-yl)phthalide, 3,3'-bis(1-ethyl-2-methylindole-3-yl)-phthalide, rhodamine-B-anilinolactam, rhodamine-B-(o-chloroanilino)lactam, 3-diethylamino-7-o-fluoroanilinofluoran, 3-dimethylamino-7-o-fluoroanilinofluoran, 3-diethylamino-7-o-chloroanilinofluoran, 3-dimethylamino-7-o-chloroanilinofluoran, 3-(N-cyclohexyl-N-methylamino)-6-methyl-7-phenylaminofluora n, 3-diethylamino-6-methyl-7-phenylaminofluoran, 3-diethylamino-6-methyl-7-chlorofluoran, 3-diethylamino-7,8-benzofluoran, 2,2-bis(4-(6'-(N-cyclohexyl-N-methylamino)-3'-methylspiro(phthalide-3,9'-xanthene)-2'-ylamino)phenyl)propane, and 3,6,6'-tris(dimethylamino)spiro(fluorene-9,3'phthalide).

In respect of improving the visibility, the laser discoloration layer 6 may contain a pigment. Examples of the pigment include a yellow pigment, a red pigment, a deep blue (indigo blue) pigment, and a white pigment. Preferred examples of the white pigment include titanium oxide. Examples of the titanium oxide include anatase-type and rutile-type titanium oxides.

The laser discoloration layer 6 may contain an addition agent. Examples of the addition agent include a pigment dispersant, an antifoamer, a leveling agent, wax, a silane coupling agent, an antiseptic agent, a rust-preventive agent, a plasticizer, a fire retardant, an organic solvent, and water.

In respect of the visibility of the marking, the thickness of the laser discoloration layer 6 is preferably equal to or greater than 0.5 μm, and more preferably equal to or greater than 1 μm. In respect of the strength of the laser discoloration layer 6, the thickness of the laser discoloration layer 6 is preferably equal to or less than 100 μm.

In the embodiment, a portion to which the marking M1 is applied does not constitute a recessed part. In the embodiment, the portion to which the marking M1 is applied does not constitute a projecting part. Unevenness is not produced by the marking. The surface of the portion to which the marking M1 is applied continues smoothly to the circumference. Therefore, while the smooth curved surface or plane of the surface can be maintained, the marking M1 can be applied.

The marking of the embodiment does not produce a flaw and a recessed part on the surface. Since the surface is smooth even after the marking M1 is applied, the fine appearance of the golf club is maintained. For example, smoothness is required for the surface of the crown of the head. If the flaw or the like exists on the crown, it may be difficult to address the golf club. The head which is difficult to be addressed may cause an erroneous shot.

The marking M1 can be used for not only the character and the picture but also the pattern. The marking M1 can express a color which is hardly expressed by coating, for example.

The golf club can be irradiated with the laser beam with high positional accuracy. A narrow area can be irradiated with the laser beam. Therefore, a pattern and a color or the like which are hardly achieved by the coating can be expressed by the laser beam.

For example, a photograph can be reproduced by using the laser beam. That is, the marking M1 can constitute the photograph (or a pattern approximate to the photograph). The protection layer 8 can improve the glossy feel of the photograph.

A glossy feel and a high-grade feel or the like can be applied to the marking M1 by the existence of the protection layer 8. The marking M1 having excellent fine appearance can be realized by the existence of the protection layer 8.

Laser marking has high convenience. Since the marking M1 is immediately formed by the irradiation of the laser beam, less time is required for the laser marking than the coating. Furthermore, the marking M1 has the protection layer 8. The labor and time of applying the protection layer after the marking are not required. Therefore, for example, the marking can be applied to the golf club in a shop, and the golf club can be taken to a customer soon. For example, the name of a customer purchasing a golf club can be subjected to marking, and the golf club can be given to the customer soon. The marking provided by the laser beam has excellent commercial value, and can improve customer satisfaction.

The laser discoloration layer 6 is protected by the protection layer 8. Therefore, the marking M1 is protected by the protection layer 8. A strong impact acts on the golf club. The golf club may collide with other member during use. For example, clubs may collide with each other in a caddie bag. The flaw may be generated on the surface of the club by the collision. Friction with a ground or a grass may be generated in the case of a shot. The flaw may be generated on the head by the friction. The marking M1 is effectively protected from the collision and the friction by the protection layer 8.

Examples of a usable laser kind include a solid-state laser, a gas laser, and a liquid laser. In the solid-state laser, a solid is used as a medium. The medium is a substance causing induced emission. In the gas laser, a gas is used as a medium. In the liquid laser, a liquid is used as a medium.

Examples of the solid-state laser include a YAG laser and a $YVO_4$ laser. Examples of the YAG laser include an Nd:YAG laser, an Er:YAG laser, and a CTH:YAG laser. Examples of the $YVO_4$ laser include an Nd:$YVO_4$ laser. The wavelength of the Nd:YAG laser is 1.064 μm (1064 nm). The wavelength of the Nd:$YVO_4$ laser is 1.064 μm (1064 nm).

Examples of the gas laser include a $CO_2$ laser. The wavelength of the $CO_2$ laser is 10.6 μm.

Examples of a laser apparatus include $YVO_4$ laser marker MD-V9600 manufactured by Keyence Corporation.

The irradiation of the laser can be controlled by a computer. A step of forming the marking M1 includes, for example, a step of creating the data of the marking M1 using graphic software, a step of transmitting the data to a driver controlling laser radiation, and a step of performing the laser radiation based on the data.

Examples of a marking method using the laser include the following methods:

(1) a method for peeling coating or printing provided on a work surface using the laser;

(2) a method for scraping the work surface using the laser to form engraving; and (3) a method for discoloring a work body itself using the laser.

In respects of the durability and the fine appearance, the methods (1) and (2) cannot be said to be preferable for the golf club. The embodiment can have more excellent durability, visibility, and appearance than those of the methods (1) to (3).

EXAMPLES

Hereinafter, the effects of the present invention will be clarified by examples. However, the present invention should not be interpreted in a limited way based on the description of the examples.

A metal head body was produced by a known method. A colored coating material was applied to the head body as an undercoat layer 4. An urethane resin was used as the base material resin of the coating material. A pinhole or the like was filled with putty after the application, and the colored coating material as the undercoat layer 4 was applied again. The undercoat layer 4 was applied with a spray gun.

Next, a coating material containing a laser discoloration material was applied as a laser discoloration layer 6. An urethane resin was used as the base material resin of the coating material. A copper-molybdenum composite oxide was used as the laser discoloration material. The laser discoloration layer 6 was applied with the spray gun.

Next, a clear coating material was applied as a protection layer 8. An urethane resin was used as the base material resin of the clear coating material. The protection layer 8 was applied with the spray gun. Thus, a head according to Example was obtained.

The head was irradiated with a laser beam to form a marking M1. $YVO_4$ laser marker MD-V9600 manufactured by Keyence Corporation was used for the irradiation. Only the laser discoloration layer 6 was colored by the irradiation of the laser beam. Only a portion irradiated with the laser beam was colored. A character shown in FIG. 1 was obtained as the marking M1 by the coloring.

The method described above can be applied to all golf clubs.

The description hereinabove is merely for an illustrative example, and various modifications can be made in the scope not to depart from the principles of the present invention.

What is claimed is:

1. A golf club comprising a base part constituting a portion of the golf club, a laser discoloration layer, and a protection layer, wherein the laser discoloration layer is provided on the outer side of the base part;

the protection layer is provided on the outer side of the laser discoloration layer;

the protection layer has laser beam transparency; and the laser discoloration layer can be discolored by irradiation of a laser beam, wherein the laser discoloration layer comprises a base material resin and a laser discoloration material.

2. The golf club according to claim 1, further comprising an undercoat layer provided between the base part and the laser discoloration layer, wherein the undercoat layer is not discolored by the laser beam.

3. The golf club according to claim 1, wherein the base part is a metal.

4. The golf club according to claim 1, wherein the base part is a fiber-reinforced resin.

5. The golf club according to claim 1, wherein the base material resin of the laser discoloration layer is an urethane resin.

6. The golf club according to claim 1, wherein the laser discoloration material is a metal, a metal salt, a metal hydroxide or a metal oxide.

7. The golf club according to claim 1, wherein the laser discoloration material is an electron-donating color developing compound.

8. The golf club according to claim 7, wherein the electron-donating color developing compound is a leuco coloring matter.

9. A golf club comprising a base part constituting a portion of the golf club, a laser discoloration layer, and a protection layer, wherein the laser discoloration layer is provided on the outer side of the base part;

the protection layer is provided on the outer side of the laser discoloration layer;

the protection layer has laser beam transparency;

the laser discoloration layer can be discolored by irradiation of a laser beam; and an undercoat layer provided between the base part and the laser discoloration layer, wherein the undercoat layer is not discolored by the laser beam.

10. A golf club comprising a base part constituting a portion of the golf club, a laser discoloration layer, and a protection layer, wherein the laser discoloration layer is provided on the outer side of the base part;

the protection layer is provided on the outer side of the laser discoloration layer;

the protection layer has laser beam transparency; and the laser discoloration layer can be discolored by irradiation of a laser beam, wherein the base part is a fiber-reinforced resin.

* * * * *